US005195868A

United States Patent [19]

Plemmons et al.

[11] Patent Number: 5,195,868

[45] **Date of Patent: * Mar. 23, 1993**

[54] HEAT SHIELD FOR A COMPRESSOR/STATOR STRUCTURE

[75] Inventors: Larry W. Plemmons, Fairfield; Mark S. Rocklin, Wyoming; Jay A. Benson, Fairfield, all of Ohio

[73] Assignee: General Electric Company, Cincinnati, Ohio

[ * ] Notice: The portion of the term of this patent subsequent to Dec. 29, 2009 has been disclaimed.

[21] Appl. No.: 727,186

[22] Filed: Jul. 9, 1991

[51] Int. Cl.[5] ..... F01D 25/08

[52] U.S. Cl. ..... 415/177; 415/178; 29/888.01; 29/888.3; 29/525.1

[58] Field of Search ..... 415/177, 178, 170.1, 415/173.1, 173.3, 174.2, 174.4; 29/888.01, 888.3, 525.1

[56] References Cited

U.S. PATENT DOCUMENTS

| | | | |
|---|---|---|---|
| 3,365,172 | 1/1968 | McDonough et al. | 415/173.4 |
| 3,423,070 | 1/1969 | Corrigan | 415/173.4 |
| 3,656,862 | 4/1972 | Rahaim et al. . | |
| 3,728,041 | 4/1973 | Bertelson . | |
| 3,970,319 | 7/1976 | Carroll et al. | 415/173.4 |
| 3,986,789 | 10/1976 | Pask | 415/178 |
| 4,087,199 | 5/1978 | Hemsworth et al. . | |
| 4,101,242 | 7/1978 | Coplin et al. . | |
| 4,309,145 | 1/1982 | Viola . | |
| 4,398,866 | 8/1983 | Hartel et al. . | |
| 4,405,284 | 9/1983 | Albrecht et al. . | |
| 4,525,998 | 7/1985 | Schwarz . | |
| 4,565,492 | 1/1986 | Bart et al. . | |
| 4,826,397 | 5/1989 | Shook et al. . | |

*Primary Examiner*—Edward K. Look
*Assistant Examiner*—Christopher M. Verdier
*Attorney, Agent, or Firm*—Jerome C. Squillaro; John R. Rafter

[57] ABSTRACT

A heat shield mechanism for thermally protecting a casing located in a turbine engine having a plurality of honeycomb cells which are connected to a support plate. A spring in contact with the support plate and in contact with a vane liner exerts a force on the support plate which causes at least one of the plurality of honeycomb cells to be pressed against the casing.

11 Claims, 4 Drawing Sheets

HEAT SHIELD FOR A COMPRESSOR/STATOR STRUCTURE

CROSS-REFERENCE

This application is related to co-pending U.S. patent application Ser. No. 07/727,178; 07/727,182; 07/727/189; and 07/727,268 filed concurrently herewith and assigned to the assignee of the present invention, the disclosure of which is hereby incorporated by reference.

BACKGROUND OF THE INVENTION

The present invention pertains to heat shields for gas turbine engines and, more particularly, to a heat shield mechanism having a plurality of honeycomb cells aligned in a radially outward manner and which are resiliently biased to maintain at least one honeycomb cell of the plurality of honeycomb cells in contact with an engine casing so as to reduce and eliminate flow gas between the honeycomb cells and casing.

In prior art gas turbine engines, thermal insulation blankets have been used to shield compressor casing walls from the flow path of hot gases that leak through the vane retainers after exiting the compressor stage of the engine. These hot gases are known to cause thermal damage to the casing and detrimentally affect engine performance.

Thus, a need is seen for a heat shield mechanism which can effectively protect the casing wall of a turbine engine from detrimental thermal effects.

SUMMARY OF THE INVENTION

Accordingly, one object of the present invention is to provide a novel heat shield mechanism for thermally isolating a casing contained in a turbine engine from leaked hot flow path gases.

Yet another object of the present invention is to improve engine performance by achieving reduced blade-case radial clearance by reducing the casing temperature.

Still another object of the present invention is to improve the creep life of the casing flange thereby maintaining the original manufactured dimensions.

These and other valuable objects and advantages of the present invention are provided by a heat shield mechanism for thermally protecting a casing located in a turbine engine. The heat shield mechanism comprises a plurality of metal honeycomb cells connected to a support plate. The plurality of honeycomb cells is aligned in a radially outward manner. Resilient biasing means such as a spring acts as a gap reducing means and continuously urges the heat shield radially outward into engagement with an adjacent inner surface of the casing. The spring exerts a force on the honeycomb cells causing them to be in proximate contact with the casing of the turbine engine. Thus, flow gaps are eliminated and dead air spaces created reducing thermal damage to the engine components and enhancing engine performance.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein.

When referring to the drawings, it is understood that like reference numerals designate identical or corresponding parts throughout the respective figures.

DETAILED DESCRIPTION OF THE INVENTION

Figure 1:
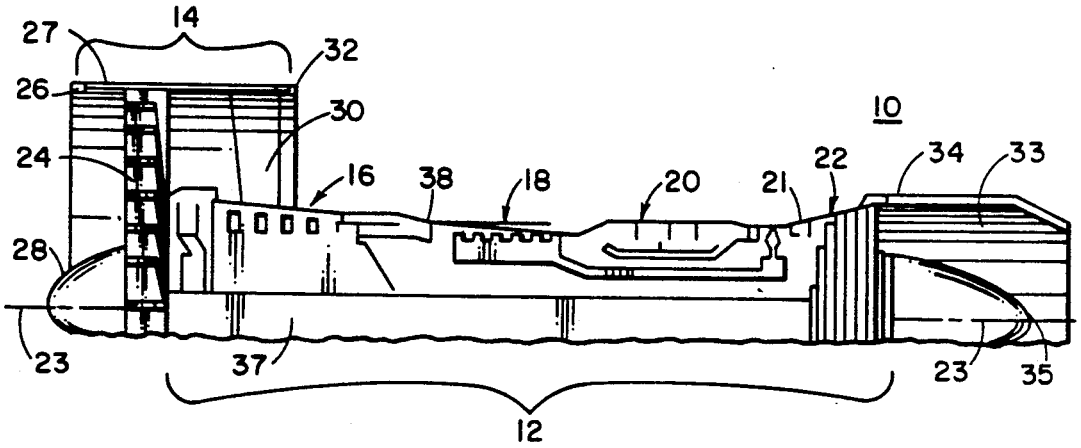
FIG. 1 (PRIOR ART)
FIG. 1 is a partial cross-sectional illustration of an exemplary high-bypass ratio gas turbine engine.

Referring first to FIG. 1, there is shown a partial cross-sectional drawing of an exemplary high-bypass ratio gas turbine engine 10 having a rotor engine portion indicated at 12 and a stator or fan portion indicated at 14. The engine portion 12 may be referred to as the rotor module. The rotor engine portion 12 includes an intermediate pressure compressor or booster stage 16, a high pressure compressor stage 18, a combustor stage 20, a high pressure turbine stage 21, and a low pressure turbine stage 22 all aligned on an engine centerline 23. The engine further includes fan blades 24 and a spinner assembly 28. The fan portion 14 comprises fan cowling 27 and fan casing 26. The fan cowling 27 surrounds the fan casing 26 and radially encloses the fan portion of the engine 10.

The fan spinner assembly 28 located forward of the fan blades 24 connects to a rotor assembly (not shown) drivingly coupled to blades 24 and being driven by turbine stage 22. To the aft of fan blades 24 is located a plurality of circumferentially spaced outlet guide vanes or fan frame struts 30 which are a part of the fan portion 14. The outlet guide vanes 30 connect the engine portion 12 to the fan portion of the engine 10 and provide structural support. At the rear of engine 10 is located primary nozzle 33 which includes an outer member 34 and an inner member 35. The fan shaft 37 driven by turbine stage 22 extends through the engine and is coupled in driving relationship with booster stage 16 and fan blades 24 via the fan rotor assembly. The engine portion 12 is positioned in and supported by an outer casing 38.

Figure 2:
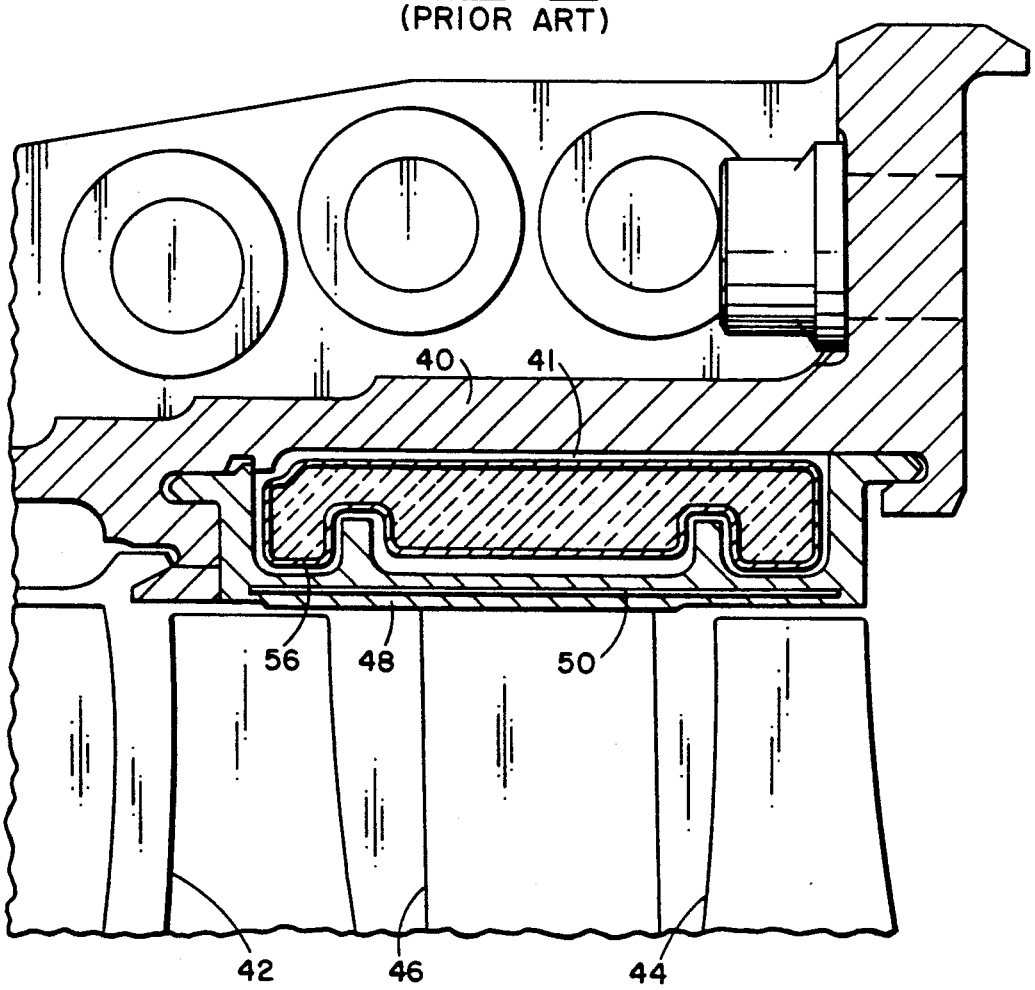
FIG. 2 (PRIOR ART)
FIG. 2 is a schematic cross-sectional view of a prior art compressor case and surrounding structure.

FIG. 2 is an enlarged view of a portion of engine 10 adjacent a radially outer circumference of a prior art compressor case 40, a forward row of blades 42, an aft row of blades 44, and an intermediate nozzle vane 46. A vane liner 48 extends circumferentially about engine 10 and supports a plurality of spaced vanes 46 while providing a radially outer sealing surface for fluid flow through blades 42, 44, and vane 46. The vane liner 48 generally comprises a plurality of arcuate segments each supporting a preselected number of nozzle vanes 46. Between each adjacent vane liner segment is a horizontal leaf seal 50. Between the liner 48 and the casing 40 is an insulation blanket 56 which insulates the compressor case 40 from the hot fluid flow within the compressor.

During engine operation, temperature changes and temperature differentials combined with different thermal growth rates for various engine components causes separation of the various components such that gaps are created which allow air to enter into sundry spaces between components, such as, for example, the space 41 between the casing 40 and vane liner 48. Within the compressor stage, pressure increases from an axial forward end to an axially aft end, i.e., from left to right in FIG. 2. This same relationship occurs in the space 41 so that the static air pressure at the axially aft end is higher than the static air pressure at the axially forward end. In addition, the air in cavity 41 may have a circumferential pumping flow component induced by rotation and eccentricity of blades 42 and 44 as well as other blades. The pressure differential and circumferential flow creates a counterclockwise air flow within cavity 41. The air in the cavity is generally at a higher temperature than the casing 40 and thus can contribute to thermal distortion of the casing if allowed to circulate over the casing surface. The blanket 56 is intended to restrict this flow as well as reduce heat flow by creating a dead air space and thus minimize thermal heating of the casing.

The gaps between casing 40 and blanket 56 are typically caused by contour discontinuities caused by a lack of compliance in the internal material of the blanket. Gaps between the liners and casing exist due to piece-part tolerance and actually decrease during engine operation.

Figure 3:
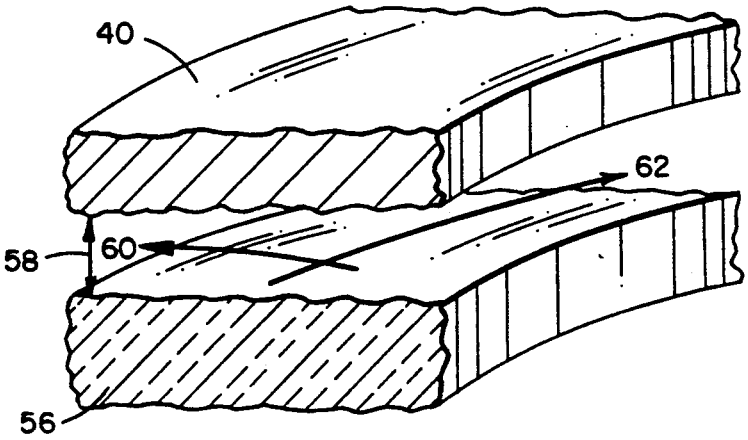
FIG. 3 (PRIOR ART)
FIG. 3 is an exemplary schematic illustration of the axial and circumferential air flow which occurs between the casing wall and insulation blankets of prior art turbine engines.

With reference to FIG. 3, there is illustrated the relationship between the casing 40 and insulation blanket 56 following engine operation which demonstrates the problem inherent in the use of prior art insulation blankets comprised of fibrous material. Engine vibration, thermal cycling, and installation deformation cause the fibrous material to shift creating gaps between the blanket 56 and adjacent portions of casing 40. This shifting and surface discontinuities create a gap 58 which allows axial air flow, indicated by arrow 60, and circumferential air flow, indicated by arrow 62, to flow unobstructed with increased velocity resulting in undesirable heating of the casing 40 and detrimentally affecting engine performance. It is therefore desirable to provide a method and apparatus for insulating casing 40 from such hot fluid and parasitic leakage, and which eliminate convective heat transfer even when the insulation means is not in intimate contact with the casing.

Figure 4:
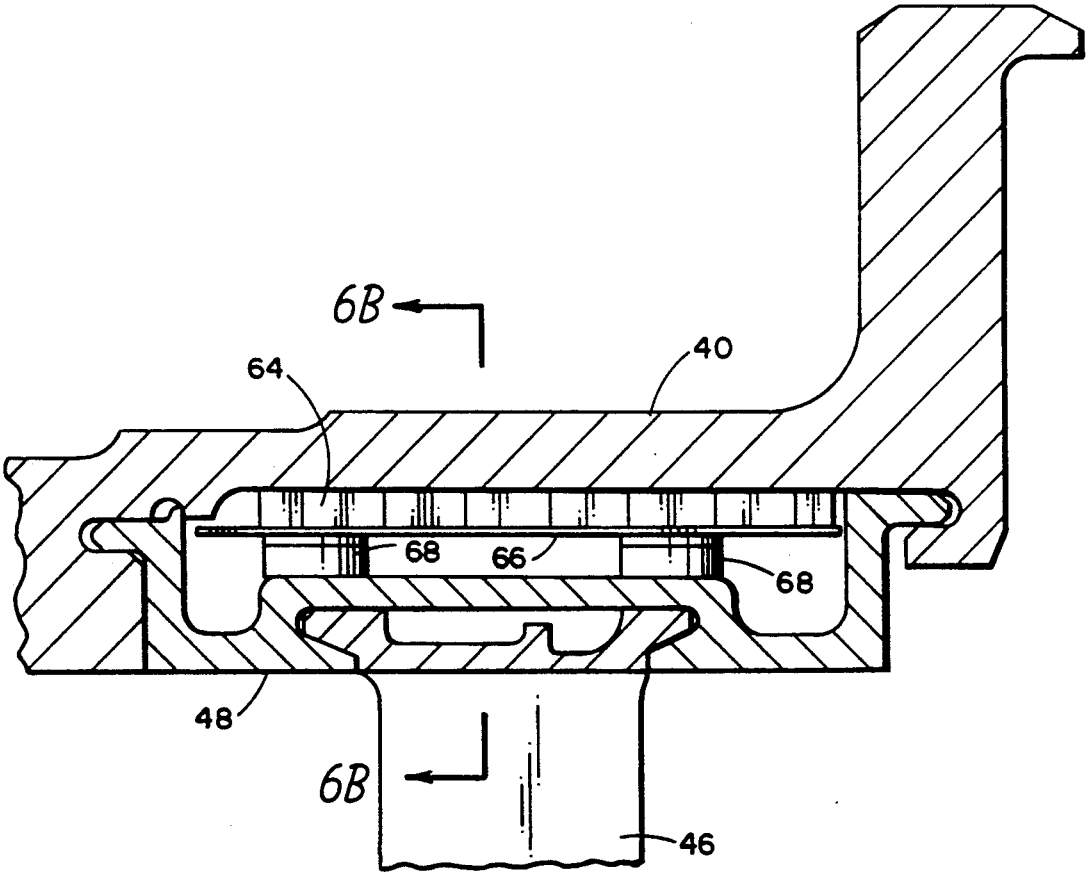
FIG. 4 is a schematic cross-sectional illustration of the honeycomb support plate and radial spring mechanism in one form of the present invention.

With reference to FIG. 4, there is shown a view similar to that of FIG. 2 but in which the blanket 56 is replaced by a thermal shield 64 comprising a plurality of tubular hexagonal honeycomb cells having radially outward open ends adjacent to the casing 40 and radially inward ends closed by a backing sheet and braze material 66. Also, it is possible to not have a backing so that the biasing means (which is discussed immediately hereafter) contacts the honeycomb cells directly. The shield 64 is held in abutting contact with the inner surface of casing 40 by a plurality of resilient biasing means illustrated as a folded leaf spring 68. The springs 68 continuously urge the shield 64 against the casing 40 and thus minimize any separation or gap formation between the shield and casing. The metal honeycomb heat shield is cut from sheets of commercially available honeycomb material. The sheets are available in various thicknesses and with various honeycomb cell sizes. Certain thickness and cell sizes suitable for the present use are discussed hereinafter.

As in FIG. 2, the vane liner 48 (FIG. 4) has a plurality of arcuate segments each supporting a preselected number of nozzle vanes 46. Between each adjacent vane liner segment there is the horizontal leaf seal 50, a vertical forward leaf seal (not shown), and a vertical aft leaf seal (not shown). The leaf seals fit in slots in mating surfaces of adjacent vane liners. The leaf seals allow the plurality of vane liners to be connected circumferentially around the engine to form a substantially continuous flow guide for fluid flow through the compressor.

Figure 5:
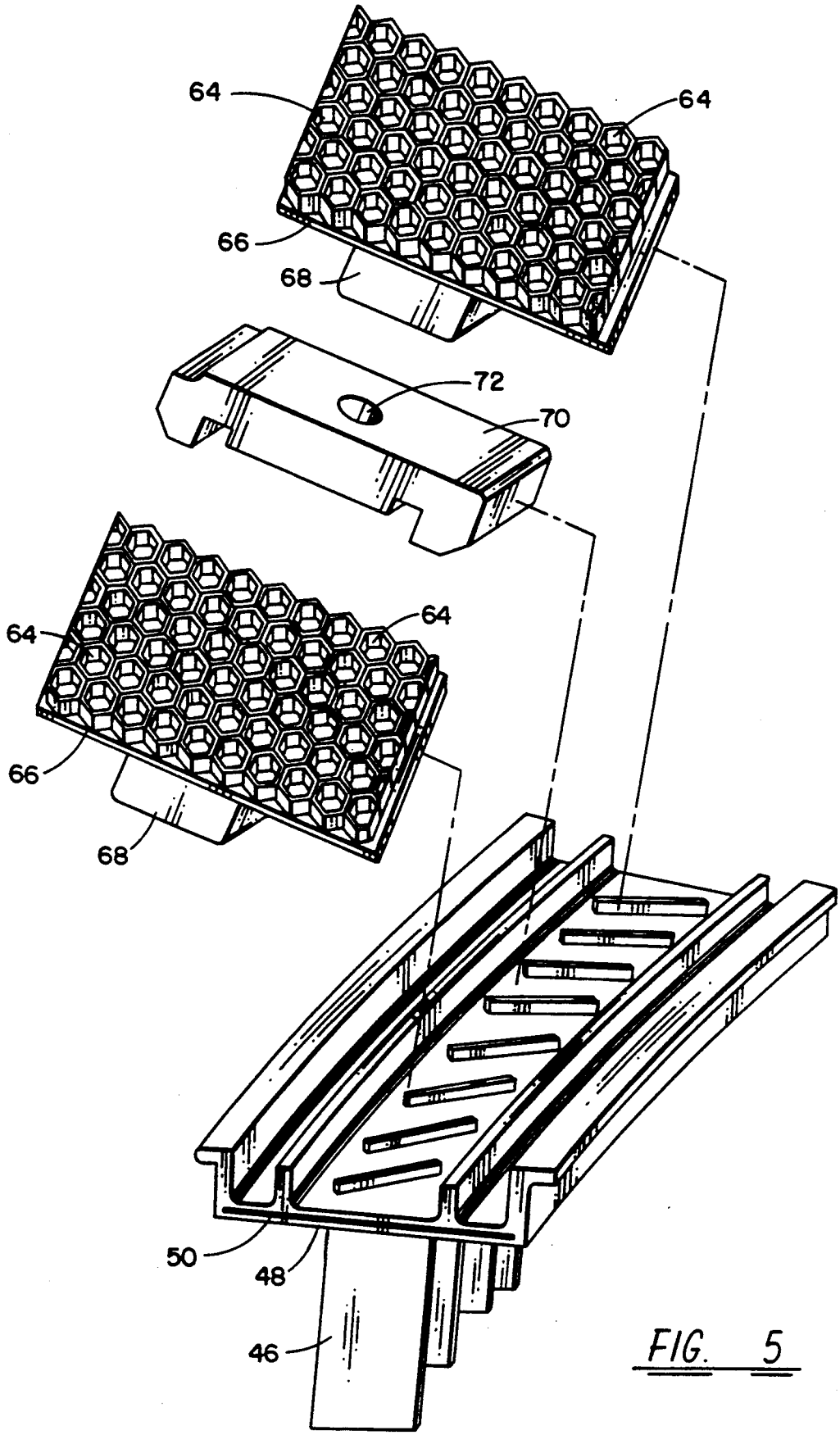
FIG. 5 is an exploded view depicting the honeycomb cells, support plate, and mounting structure in another form of the present invention.
Figure 6A:
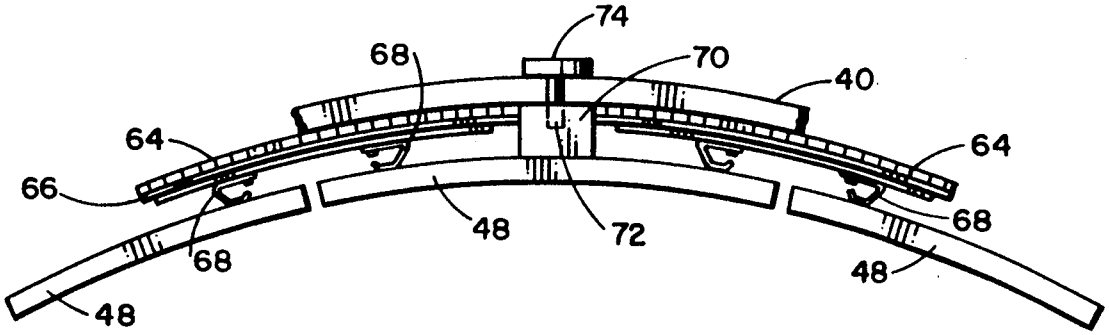
FIG. 6A is a simplified schematic illustration depicting the spatial relationships of the honeycomb cells, support plate, and radial springs according to the form of the invention shown in FIG. 5.

With reference to FIGS. 5 and 6A, there is shown one arrangement for positioning and supporting the metallic honeycomb heat shields 64 above the vane liner 48. For purposes of simplifying the illustration, only limited segments of the honeycomb shields 64 are shown in FIG. 5. Each vane liner 48 is an arcuate segment of predetermined length supporting a plurality of vanes 46, e.g., eight vanes. Each segment of liner 48 is attached to casing 40 by a vane liner retainer 70. The vane liner retainer 70 is brazed to vane liner 48 and includes a threaded aperture 72. The aperture 72 is aligned with a mating aperture in the casing 40 and a bolt 74 inserted to draw the vane liner 48 into its assembled position with respect to casing 40. A shield 64 is inserted between each adjacent retainer 70 so that each shield 64 overlaps adjacent ends of joined vane liners 48.

Figure 6B:
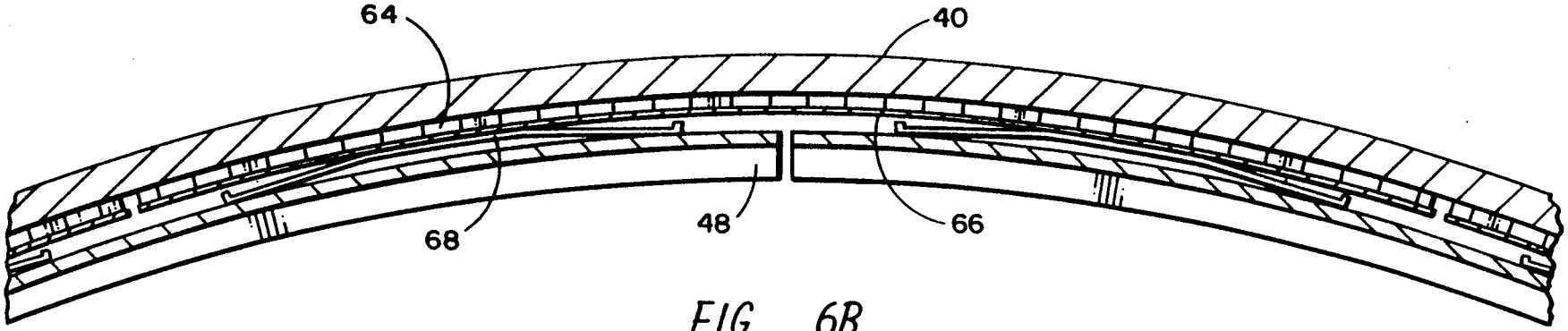
FIG. 6B illustrates a bow-shaped spring brazed to the backing connected to the heat shield in the form of the present invention shown in FIG. 4.

Testing has shown that the overlap acts as an inhibitor to radial impingement of gases on the casing. Springs 68 are positioned between the shields 64 and vane liners 48 so that the shields are urged against the casing 40. The number of springs 68 may be adjusted to provide sufficient force to retain the shields 64. Two springs 68 for each shield segment are shown in FIG. 6A. Alternatively, in the embodiment illustrated in FIG. 6B, a single bow-shaped spring 69 provides the support of the two springs shown in FIG. 6A. Spring 69 of FIG. 6B is brazed to backing 66 and makes contact with vane liner 48.

In the prior art system of FIG. 2, thermal insulation blankets 56 are used to shield the compressor casing 40 from the flow path of hot gases that leak around the vane retainers 48. However, as explained with respect to FIG. 3, hot gases can still influence the casing 40 due to gaps between the insulation blanket 56 and casing 40.

The metal honeycomb cell structure of shields 64 retard the velocity of any gases traversing circumferentially and axially between the casing 40 and shield 64. While the springs 68 keep at least some portions of the shields 64 in contact with the casing 40 inner surface so as to minimize gaps, differential thermal growth and thermal distortion preclude all of the honeycomb cells from being i n contact with the casing 12 during all phases of the operation of the engine 10. However, the open ends of the honeycomb cells create a viscous drag which tends to reduce air flow toward zero velocity. The resultant velocity reduction of the hot gas flow over the casing surface reduces the heat transferred to the casing 40 and allows temperatures to be reduced by cooler external (outer surface) air.

The honeycomb shields 64 preferably have a cell size of ¼ of an inch and have a ribbon thickness of about 0.001 inch to about 0.003 inch. The ribbon thickness and cell density reduce surface area for heat conductance. This cell size and ribbon thickness have been found to produce the desired viscous flow effect adjacent the shield surface at the open ends of the cells. Any smaller cell size or thickness makes the surface too uniform to create the desired flow impediment.

While the heat shield 64 of the present invention protects casing 40 from thermal damage, the springs 68 have been found to dampen shield vibration and thus reduce frictional wear. Furthermore, the present invention, in maintaining the casing 40 in a cooler state, reduces blade-to-case clearance which in turn improves the performance of the engine. Still further, the reduced casing temperature achieved with the present invention improves the creep life of the casing thereby maintaining the original manufacturing dimensions of improved engine performance.

The foregoing detailed description is intended to be illustrative and non-limiting. Many changes and modifications are possible in light of the above teachings. Thus, it is understood that the invention may be practiced otherwise than as specifically described herein and still be within the scope of the appended claims.

What is claimed is:

1. A method of assembling a gas turbine engine, the gas turbine engine including a casing defining in part at least one cavity for separating the flow of high energy compressed air from the casing, a thermal shield including a plurality of adjacent honeycomb cells each having an open end and a closed end, the method comprising the steps of:

associating the thermal shield in thermal insulating relation with the casing within the at least one cavity and arranging the thermal shield in engagement with the casing generally about at least some of the open ends of the honeycomb cells with the thermal shield adjacent the closed ends of the honeycomb cells being exposed to the at least one cavity during the associating step; and resiliently biasing the thermal shield into engagement with the casing to impede and slow down the flow of high energy compressed air.

2. A method of insulating a casing structure in a gas turbine engine from a high energy working medium flow, the method comprising the steps of:

a) spacing at least part of the casing from the high energy flow with at least one cavity adjacent the casing;

b) supporting a multi-celled insulator structure in the cavity with at least some of the multiple cells having open ends facing the casing; and c) wherein said step of supporting comprises urging said multi-celled insulator structure radially outward against said casing for thermally insulating said casing from said high energy working medium.

3. A gas turbine engine comprising:

a casing defining in part at least one cavity for separating the flow of compressed air within said engine from said casing;

means for thermally insulating said casing within said at least one cavity, said thermally insulating means including a plurality of generally adjacent honeycomb cells each having an open end and a closed end, said thermally insulating means being engaged with said casing generally about the open end of at least some of said honeycomb cells and being exposed to said at least one cavity adjacent said closed ends of said honeycomb cells; an means for resiliently biasing said thermally insulatinq means into engagement with said casing.

4. The gas turbine as set forth in claim 3 wherein said resiliently biasing means comprises spring means associated with said thermal insulating means for maintaining said thermally insulating means in a preselected position within said at least one cavity with respect to said casing.

5. The gas turbine as set forth in claim 3 wherein said closed ends of said honeycomb cells define a generally uniform surface exposed to said at least one cavity.

6. The gas turbine as set forth in claim 3 wherein said open ends of others of said honeycomb cells in said thermally insulating means are displaced from said casing in response to thermal distortion of at least one of said casing and said others of said honeycomb cells.

7. The gas turbine as set forth in claim 3 wherein said thermally insulating means further includes means associated therewith for closing said closed ends of said honeycomb cells and for presenting a generally uniform surface to said at least one passage means.

8. The method of claim 1, wherein said step of resiliently biasing comprises dampening vibrations of said thermal shield to reduce frictional wear on said thermal shield.

9. The method of claim 2, wherein said step of supporting comprises dampening vibrations of said multi-celled insulator structure to reduce frictional wear on said multi-celled insulator structure.

10. The method of claim 9, further comprising the step of creating a high viscous drag on a leakage flow entering a gap between said open ends of said at least some of said multiple cells and said casing, thereby impeding said leakage flow.

11. The gas turbine as set forth in claim 6, wherein said open ends of said others of said honeycomb cells create a high viscous drag on a leakage flow entering a gap between said open ends of said others of said honeycomb cells and said casing, thereby impeding said leakage flow.

* * * * *

UNITED STATES PATENT AND TRADEMARK OFFICE

CERTIFICATE OF CORRECTION

PATENT NO. : 5,195,868

DATED : March 23, 1993

INVENTOR(S) : Plemmons, et al

It is certified that error appears in the above-identified patent and that said Letters Patent is hereby corrected as shown below:

On the title page: Item[75]"Inventors" after "Fairfield" --Srubuvasab Venkatasubbu, Cincinnati--.

Signed and Sealed this

Sixteenth Day of November, 1993

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,195,868

DATED : March 23, 1993

INVENTOR(S) : Plemmons, et al.

It is certified that error appears in the above-identified patent and that said Letters Patent is hereby corrected as shown below:

On the title page: Item [75] "Inventors" after "Fairfield," add --Srinivasan Venkatasubbu, Cincinnati,--.

This certificate supersedes Certificate of Correction issued November 16, 1993.

Signed and Sealed this

Twelfth Day of April, 1994

Bruce Lehman

*Attest:*

BRUCE LEHMAN

*Commissioner of Patents and Trademarks*

*Attesting Officer*